US005601767A

United States Patent [19]

Firgo et al.

[11] Patent Number: 5,601,767

[45] Date of Patent: Feb. 11, 1997

[54] PROCESS FOR THE PRODUCTION OF A CELLULOSE MOULDED BODY

[75] Inventors: Heinrich Firgo; Dieter Eichinger, both of Vöcklabruck; Markus Eibl, Lambach, all of Austria

[73] Assignee: Lenzing Aktiengesellschaft, Austria

[21] Appl. No.: 483,565

[22] Filed: Jun. 6, 1995

[30] Foreign Application Priority Data

Sep. 5, 1994 [AT] Austria ..... A 1698/94

[51] Int. Cl.[6] ..... B29C 47/00; C08J 3/11; D01F 2/24

[52] U.S. Cl. ..... 264/101; 162/4; 162/5; 162/53; 162/70; 162/81; 162/91; 162/95; 162/97; 264/187

[58] Field of Search ..... 264/101, 187; 162/4, 5, 53, 70, 81, 91, 95, 97; 106/203

[56] References Cited

U.S. PATENT DOCUMENTS

| | | | |
|---|---|---|---|
| 2,179,181 | 11/1939 | Graenacher et al. | 106/203 |
| 3,447,939 | 6/1989 | Johnson | 106/135 |
| 3,447,956 | 6/1989 | Johnson | 162/158 |
| 3,508,941 | 4/1970 | Johnson | 106/125 |
| 4,416,698 | 11/1983 | McCorsley, III | 106/163.1 |
| 5,094,690 | 3/1992 | Zikeli et al. | 106/198 |

FOREIGN PATENT DOCUMENTS

| | | |
|---|---|---|
| 356419 | 2/1990 | European Pat. Off. . |
| 226573 | 8/1985 | Germany . |
| WO86/05526 | 9/1986 | WIPO . |

OTHER PUBLICATIONS

Firgo et al., "Kritische Fragen Zur Zukunft Der NMMO-Technologie", pp. 81–89 (Sep. 9, 1994).

English language abstract of DD 226,573 (Published Aug. 28, 1985).

English language abstract of EP 356,419 (Published Feb. 28, 1990).

Taeger et al., "Das Papier", 12, pp. 784–788 (1991).

"Holzforschung", 42, pp. 21–27 (1988).

*Primary Examiner*—Leo B. Tentoni

*Attorney, Agent, or Firm*—Brumbaugh, Graves, Donohue & Raymond

[57] ABSTRACT

A process for the production of a cellulose moulded body, particularly cellulose fibres, characterized by the combination of the measures of feeding a cellulose-containing material into an aqueous solution of a tertiary amine-oxide in order to suspend said cellulose-containing material, removing water from the suspension while intensively mixing it and providing elevated temperature and reduced pressure, until a solution of cellulose is produced and moulding said solution by means of a moulding device, particularly a spinneret, and introducing it into a precipitation bath in order to precipitate the dissolved cellulose, provided that as said cellulose-containing material, basically shredded waste paper, shredded cellulose-containing fibre assemblies and/or shredded, mechanically and/or chemically broken up annual plants are used.

14 Claims, No Drawings

PROCESS FOR THE PRODUCTION OF A CELLULOSE MOULDED BODY

The present invention is concerned with a process for the production of a cellulose moulded body.

BACKGROUND OF THE INVENTION

As an alternative to the viscose process, in recent years there has been described a number of processes in which cellulose, without derivatization, is dissolved in an organic solvent, a combination of an organic solvent and an inorganic salt, or in aqueous salt solutions. Cellulose fibres made from such solutions have received by BISFA (The International Bureau for the Standardisation of man made Fibres) the generic name Lyocell. As Lyocell, BISFA defines a cellulose fibre obtained by a spinning process from an organic solvent. By "organic solvent", BISFA understands a mixture of an organic chemical and water. "Solvent-spinning" is considered to mean dissolving and spinning without derivatization.

So far, however, only one process for the production of a cellulose fibre of the Lyocell type has achieved industrial-scale realization. In this process, N-methylmorpholine-N-oxide (NMMO) is used as a solvent. For the purposes of the present specification, the abbreviation "NMMO" will be used instead of the expression "tertiary amine-oxides", NMMO denoting additionally N-methylmorpholine-N-oxide, which today is preferably used.

Tertiary amine-oxides have been known for a long time as alternative solvents for cellulose. Thus it is known for instance from U.S. Pat. No. 2,179,181 that tertiary amine-oxides are capable of dissolving high-grade chemical pulp without derivatisation and that from these solutions cellulose moulded bodies, such as fibres, may be obtained by precipitation. In U.S. Pat. Nos. 3,447,939, 3,447,956 and 3,508,941, further processes for the production of cellulose solutions, wherein cyclic amine-oxides are preferably used as solvents, are described. In all these processes, cellulose is dissolved physically at elevated temperature.

When the solution is prepared in a double screw extruder or in a stirring vessel, the pulp has to be subjected to a preactivation in order to carry out the dissolution process at sufficient speed (see "Das Papier", edition 12, pages 784–788). As preactivation, the formation and regeneration of alkali cellulose or a hydrothermical processing of the pulp have been proposed.

According to DD-A - 226 573, before the preparation of a solution, which also is carried out in an extruder, the cellulose is preactivated as well. Said DD-A starts from a suspension of cellulose containing NMMO, which first is homogenized in a stirring vessel. Then the substance density is increased to 12.5% by mass by means of centrifuging or squeezing out, whereafter the suspension is dried to a water content of from 10–15% by mass (based on NMMO) and converted to a clear solution in an extruder provided with a degassing zone at temperatures of from 75° to 120° C.

In EP-A - 0 356 419 of the applicant, a process carried out in a so-called Filmtruder is described, wherein a suspension of the shredded high-grade pulp in an aqueous tertiary amine-oxide is transported, spread as a thin layer, along a heated surface, the surface of this thin layer being subjected to reduced pressure. As the suspension is transported along the heated surface, water is evaporated and the cellulose can be dissolved, so that a spinnable cellulose solution can be removed from the Filmtruder.

All of the processes described above use high-grade chemical pulp, which is obtained e.g. from beech or spruce wood, as starting material. There is little known in the art about use of alternative cellulose-containing materials.

A processing of lignocellulose materials in the NMMO process is known from WO 86/05526. For this processing, relatively aggressive conditions are recommended. Thus for instance poplar wood is first subjected to a special hydrolysis process and the solid product thereby obtained mixed at room temperature with NMMO having a water content of 13,5%. The NMMO used is the monohydrate of NMMO, present in solid state at room temperature (melting point>70° C.). The solid mixture is homogenized, heated to 130° C. and melt, the hydrolysed wood dissolving.

In "Holzforschung", 42, pages 21–27 (1988) it is also described that lignocellulose material may be dissolved in a solution of NMMO in dimethylsulphoxide. The NMMO used is not an aqueous solution, but has a water content of 15%, also corresponding approximately to the monohydrate.

It is desirable to employ less aggressive conditions for the production of cellulose solutions or to avoid a melting process completely, since from literature it is known that cellulose as well as NMMO are subjected to a degradation process at elevated temperature, the degradation products deteriorating the physical parameters of the Lyocell fibres, such as strength and elongation.

It is the object of the invention to provide a process for the production of cellulose moulded bodies, particularly Lyocell fibres, using alternative pulp materials, i.e. no cellulose from coniferous and deciduous trees, and carrying out the preparation of the solution in the least possible aggressive way. It is desired to avoid melting of a solid mixture product.

SUMMARY OF THE INVENTION

The process according to the invention for the production of a cellulose moulded body, particularly cellulose fibres, is characterized by a combination of the measures of feeding a cellulose-containing material into an aqueous solution of a tertiary amine-oxide in order to suspend the cellulose-containing material, removing water from the suspension while intensively mixing it and providing elevated temperature and reduced pressure, until a solution of cellulose is produced and moulding the solution by means of a moulding device, particularly a spinneret, and introducing it into a precipitation bath in order to precipitate the dissolved cellulose, provided that as a cellulose-containing material, basically shredded waste paper, shredded cellulose-containing fibre assemblies and/or shredded, mechanically and/or chemically broken up annual plants are used.

Annual plants mean all cellulose-containing materials apart from coniferous and deciduous wood. As it is known, annual plants give poor or no results in the production of cellulose in the viscose process. The viscose process uses cellulose of deciduous and coniferous woods as a starting material. Among other factors, the invention is based on the finding that the alternative pulps mentioned above giving only poor results in the viscose process may be processed very well according to the Lyocell process.

The aqueous solution used for the preparation of the suspension contains the tertiary amine-oxide in the range of from 60 to 72% by mass.

An advantageous embodiment of the process according to the invention consists in employing as the cellulose material additionally high-grade chemical pulp usually used for the production of viscose. It has been shown that by addition of high-grade pulp, such as beech wood cellulose, high-grade fibres can be produced, comparable to those produced exclusively from high-grade pulp.

The process according to the invention is most preferably carried out using N-methyl-morpholine-N-oxide.

A preferred embodiment of the process according to the invention consists in producing the solution by continuously feeding the suspension of the alternative pulp material into an evacuatable, heatable vessel, spreading the fed suspension mechanically in the form of a layer or film to form two surfaces, contacting the spread suspension at one surface with a heated surface in order to supply heat, transporting the spread suspension along the heated surface while intensively mixing it, subjecting the second surface opposed to the heated surface to reduced pressure while transporting along the heated surface, in order to evaporate water until the cellulose-containing material dissolves and continuously removing the solution from the vessel.

An appropiate device by means of which this embodiment of the process according to the invention may be carried out is the Filmtruder. It has been shown that a Filmtruder is particularly appropiate for dissolving alternative pulps. It is supposed that this is due to the high shearing forces occurring in the Filmtruder.

BRIEF DESCRIPTION OF THE PREFERRED EMBODIMENTS

By means of the following Examples, a preferred embodiment of the invention is described in more detail.

EXAMPLE 1

(Used fabrics)

Used fabrics basically consisting of cotton fibres were mechanically shredded and without further preprocessing suspended in an aqueous solution of NMMO having a water content of 40% by mass, heated to 70° C. and processed in a laboratory kneader in a conventional way, at a temperature of from 90° to 105° C. and reduced pressure, to produce a cellulose solution. The content of used fabrics was chosen in a way that after evaporation of the excess water a cellulose concentration of 10% by mass was obtained.

The cellulose solution was mouldable and could be spun to cellulose fibres. The fibre parameters are shown in the subsequent Table, which also indicates the comparative parameters of fibres obtained by processing high-grade chemical pulp.

EXAMPLE 2

(Waste paper)

Example 1 was repeated using deinked waste paper instead of used fabrics and processing the suspension according to the process described in EP-A - 0 356 419 by means of a Filmtruder to form a solution. Some parameters of the fibre spun from the mouldable cellulose solution are indicated in the Table.

EXAMPLE 3

(Straw pulp)

Example 2 was repeated using shredded straw pulp having only 75% of α-cellulose instead of used fabrics. The straw pulp was obtained by breaking up straw in a conventional way according to the prehydrolysis sulfate process. Some parameters of the fibre spun from the mouldable cellulose solution are indicated in the Table.

TABLE

| Material used | Chemical pulp | Straw pulp | Waste paper | Used fabrics |
|---|---|---|---|---|
| Fibre strength cond. (cN/tex) | 36 | 31 | 20 | 37 |
| Fibre elongation cond. (%) | 11 | 10 | 10 | 10 |
| Fibre strength wet (cN/tex) | 30 | 23 | n.d. | 32 |
| Fibre elongation wet (%) | 13 | 13 | n.d. | 14 |

n.d. = not determined

From the Table it can be seen that the fibre parameters of the fibres produced from the alternative pulps waste paper, used fabrics and straw are comparable to the parameters obtained for fibres produced from high-grade chemical pulp.

Furthermore, the Examples demonstrate that the Lyocell process, which actually has a significantly lower environmental impact than the viscose process, may be employed in order to process alternative pulps, the use of which solves another environmental problem.

We claim:

1. A process for producing a cellulose molded body comprising the steps of:

a) feeding a cellulose-containing material into an aqueous solution of a tertiary amine-oxide to form a suspension of the cellulose containing material, wherein the cellulose-containing material substantially comprises a material selected from the group consisting of shredded waste paper, shredded cellulose-containing fabrics, shredded annual plants, chemically broken up annual plants and mixtures thereof, b) removing water from the suspension while simultaneously intensively mixing the suspension at elevated temperature and reduced pressure for sufficient time to produce a cellulose solution, and c) molding the cellulose solution in a molding device and introducing the molded cellulose solution into a precipitation bath wherein precipitation of cellulose occurs thereby forming a cellulose molded body.

2. A process according to claim 1 wherein the cellulose molded body is a cellulose fibre.

3. A process according to claim 2 wherein the molding device is a spinneret.

4. A process according to claim 3 wherein the aqueous solution used for the production of the suspension comprises 60 to 72% by mass tertiary amine-oxide.

5. A process according to claim 3 wherein the cellulose material further comprises high-grade chemical pulp.

6. A process according to claim 3 wherein the tertiary amine-oxide is N-methyl-morpholine-N-oxide.

7. A process according to claim 4 wherein the tertiary amine-oxide is N-methyl-morpholine-N-oxide.

8. A process according to claim 5 wherein the tertiary amine-oxide is N-methyl-morpholine-N-oxide.

9. A process for producing a cellulose solution comprising the steps of:

a) feeding a cellulose-containing material into an aqueous solution of tertiary amine-oxide to form a suspension of the cellulose-containing material, wherein the cellulose-containing material substantially comprises a material selected from the group consisting of shredded waste paper, shredded cellulose containing fabrics, shredded annual plants, chemically broken up annual plants, and mixtures thereof, b) continuously feeding the suspension into an evacuatable, heatable vessel, c) mechanically spreading the feed suspension to form a film having a first and second surfaces, d) contacting the first film surface with a heated surface, e) transporting the film along the heated surface while simultaneously intensively mixing the film, f) applying a reduced pressure to the second surface, thereby evaporating water until the cellulose-containing material dissolves, thereby forming a cellulose solution and g) continuously removing the cellulose solution from the vessel.

10. A process according to claim 9, wherein the aqueous solution used for the production of the suspension comprises 60–72% by mass tertiary amine-oxide.

11. A process according to claim 9, wherein the cellulose material further comprises high-grade chemical pulp.

12. A process according to claim 9, wherein the tertiary amine-oxide is N-methyl-morpholine-N-oxide.

13. A process according to claim 10, wherein the tertiary amine-oxide is N-methyl-morpholine-N-oxide.

14. A process according to claim 11, wherein the tertiary amine-oxide is N-methyl-morpholine-N-oxide.

* * * * *